United States Patent [19]

Yokota et al.

[11] Patent Number: 4,620,073

[45] Date of Patent: Oct. 28, 1986

[54] PRESSURE-RESPONSIVE APPARATUS HAVING HYSTERESIS TO PREVENT HUNTING

[75] Inventors: Mitsuyoshi Yokota; Akio Matsumoto, both of Himeji, Japan

[73] Assignee: Mitsubishi Denki Kabushiki Kaisha, Tokyo, Japan

[21] Appl. No.: 815,137

[22] Filed: Dec. 18, 1985

Related U.S. Application Data

[63] Continuation of Ser. No. 605,676, Apr. 27, 1984, abandoned.

[30] Foreign Application Priority Data

Jun. 18, 1983 [JP] Japan ..... 58-94015[U]

[51] Int. Cl.[4] ..... H01H 35/34

[52] U.S. Cl. ..... 200/83 P; 200/83 Q; 200/83 N; 200/302.1

[58] Field of Search ..... 92/98 R, 102; 251/61, 251/61.1; 200/83 R, 83 A, 83 B, 83 Q, 83 N, 83 P, 302

[56] References Cited

U.S. PATENT DOCUMENTS

| | | | |
|---|---|---|---|
| 2,381,582 | 8/1945 | Erickson | 200/83 N |
| 2,704,548 | 3/1955 | Ralston | 92/102 |
| 4,269,028 | 5/1981 | Hattori | 251/61 |
| 4,296,283 | 10/1981 | Boulanger | 200/83 Q |

FOREIGN PATENT DOCUMENTS

| | | | |
|---|---|---|---|
| 1204132 | 9/1970 | United Kingdom | 200/83 N |

OTHER PUBLICATIONS

English translation of the Japanese-Language document: Jidosha Kagaku Binran—Automobile Engineering Handbook, vol. 3, Paragraph 2, Section 7.

*Primary Examiner*—G. P. Tolin

*Attorney, Agent, or Firm*—Lowe Price LeBlanc Becker & Shur

[57] ABSTRACT

A snap-action diaphragm having an electrically conducting central portion is electrically insulated inside a case to separate it into two parts each of which is ported to a fluid, and is biased by an electrically conducting spring towards one port which serves as an electrical contact to form a switch with the diaphragm when connected to an external circuit. The snap-action characteristic of the diaphragm between two stable states when coacting with the biasing force of the spring provides a hysteresis force that can be predetermined to avoid hunting of the switch in response to anticipated alterations in pressure difference across the diaphragm. In another embodiment, the diaphragm also acts to open or shut a valve to control fluid flow, again with the benefit of hysteresis to prevent hunting during operation.

5 Claims, 5 Drawing Figures

PRESSURE-RESPONSIVE APPARATUS HAVING HYSTERESIS TO PREVENT HUNTING

This application is a continuation of Application Ser. No. 605,676, filed Apr. 27, 1984, now abandoned.

BACKGROUND OF THE INVENTION

1. Field of the Invention

The present invention relates generally to improvements in diaphragm apparatus and more particularly to a diaphragm type pressure responsive switch or valve having hysteresis for preventing hunting.

2. Description of the Prior Art

A typical conventional pressure-responsive apparatus for use as a switch, valve or the like has a structure and operation as described hereafter with reference to FIG. 1. The pressure-responsive apparatus has a diaphragm 4 in a metal case 1. When pressure in a vacuum tank T rises above a predetermined level, that is, when a pressure difference between a first chamber 1*b* connected to the vacuum tank T and a second chamber 3*b* exposed to the atmosphere is smaller than a predetermined amount, the diaphragm 4 is biased to the right in FIG. 1 by a compressed spring 6. Then, a switch formed between case 1 and terminal 3 is ON. The spring 6 is held between a washer 7 on an inside wall and a spring receiving seat 51 fixed to the center of the diaphragm 4. A moving contact 5 is thereby caused to contact terminal 3 fixed to the center of a plastic cap 2. As a result, an electric circuit consisting of the motor M of a vacuum pump P and a power source 20 is closed thereby operating the vacuum pump. Thereafter, the pressure of the vacuum tank T reaches a predetermined low pressure, and the pressure difference between the first chamber 1*b* and the second chamber 3*b* becomes larger than a predetermined amount. The diaphragm 4 is then biased to the left in FIG. 1 as a result of the pressure difference now overcoming the force of the spring 6. The moving contact 5 separates from the terminal 3, that is, the switch opens, deenergizing the motor M of the vacuum pump P.

In such a conventional pressure-responsive apparatus, since the diaphragm 4 is driven by the pressure difference between the first chamber 1*b* and the second chamber 3*b*, a first pressure difference to make the moving contact 5 contact the terminal 3 and a second pressure difference to make the moving contact 5 separate from the terminal 3 are substantially the same. Thus, closing and opening of the motor circuit tend to occur too frequently, responding, in practice, to every slight change of pressure in the vacuum tank T. This induces hunting of the diaphragm 4 and moving contact 5, terminal 3 and motor M, tending to shorten the lifetimes of the moving contact 5, terminal 3 and motor M.

SUMMARY OF THE INVENTION

It is an object of the invention to provide an improved pressure-responsive apparatus operable without undesirable hunting. In accordance with the present invention hunting is prevented by providing on the diaphragm a snap action characteristic which gives the diaphragm, together with a switch or valve member that it carries, hysteresis.

A pressure-responsive apparatus in accordance with the present invention comprises:

a case having a first fluid port and a second fluid port;

a snap action diaphragm within the case partitioning the interior volume of the case into a first chamber exposed to the first fluid port and a second chamber exposed to the second fluid port, and biasing means for biasing the diaphragm toward one of the ports.

Still other objects and advantages of the present invention will become readily apparent to those skilled in this art from the following detailed description, wherein I have shown and described only the preferred embodiments of the invention, simply by way of illustration of the best mode contemplated by me of carrying out my invention. As will be realized, the invention is capable of other and different embodiments, and its several details are capable of modification in various, obvious respects, all without departing from the invention. Accordingly, the drawings and description are to be regarded as illustrative in nature, and not as restrictive.

DETAILED DESCRIPTION OF A PREFERRED EMBODIMENT

Figure 1:
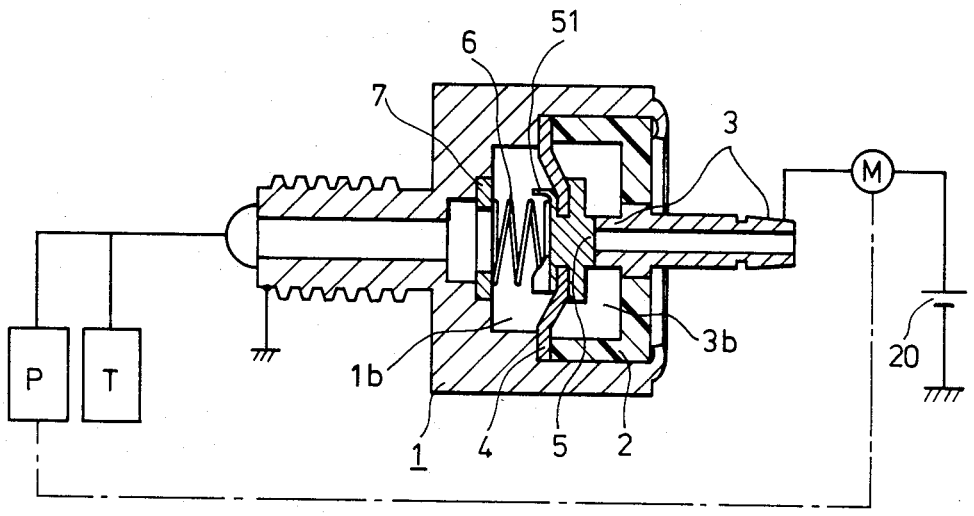
FIG.1 (Prior Art)
FIG. 1 is a cross-sectional side view of a conventional pressure-responsive apparatus and applied circuitry, used as a pressure-responsive switch within a vacuum system.
Figure 2:
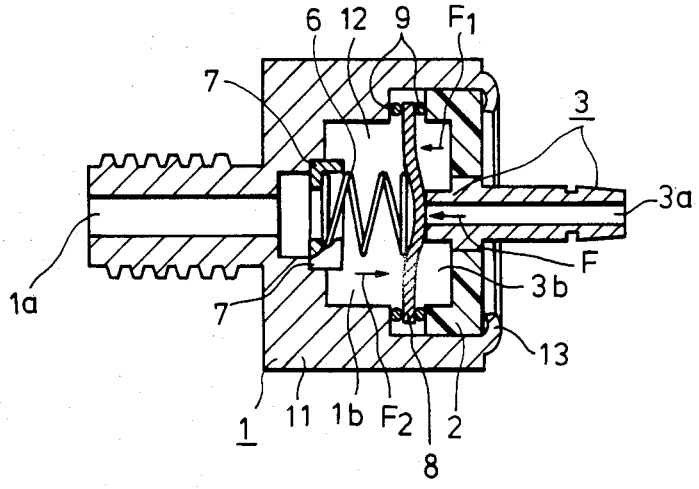
FIG. 2 is a cross-sectional side view of a preferred embodiment of a pressure-responsive apparatus embodying the present invention, in a closed state.

The structure of a preferred embodiment of the pressure-responsive apparatus embodying the present invention is described in detail with reference to FIG. 2–FIG. 5. As shown in FIG. 2, a case 1 of metal or other electrically conducting substance, is configurated substantially in a cylinder-shape having a principal part 11 defining an interior volume 12 and an open end 13 formed around a plastic cap 2 made of plastic or other dielectric material.

A first fluid port 1*a* is provided on an open end of the case 1. A terminal 3 formed of an electrically conductive material, such as a brass or contact alloy, is fixed to the plastic cap 2 and has a second fluid port 3*a*. A chamber which is formed in the case 1 is divided by a snap action type diaphragm 8 into a first chamber 1*b*, coupled to a vacuum tank T and vacuum pump P, and a second chamber 3*b*, coupled to the atmosphere. The diaphragm 8, which is made of an electric conductive material, such as a resilient metal sheet of phosphor bronze, is biased by a biasing means such as a compression spring 6 fixed by a washer 7. The diaphragm 8 has a first stable state to be biased toward the first chamber 1*b* and has a second stable state biased toward the second chamber 3*b*. The diaphragm 8 is unstable between the first stable state and the second stable state. Diaphragm 8 has a center movable part, which forms convex surface in both the first stable state and the second stable state. The spring 6 serving as an energizing means of an electrically conductive and resilient material, such as phosphor bronze, is provided mounted between the diaphragm 8 and a washer 7 fixed on a wall of the first chamber 1*b*. An O-ring 9 is on each side of the brim of the diaphragm 8 to form an air tight seal between the first chamber 1*b* and the second chamber 3*b*.

In FIG. 2, which shows the ON-state of a switch, the diaphragm 8 is pushed by a force $F_2$ of the spring 6 into contact with the terminal 3. A force $F_1$ is necessary to change diaphragm 8 from a convex shape to a concave shape (from the first stable state to the second stable state), or from a concave shape to a convex shape (from the second stable state to the first stable state). Because the diaphragm 8 has a snap action characteristic, the diaphragm passes through an unstable state between the first and second stable states.

Figure 3:
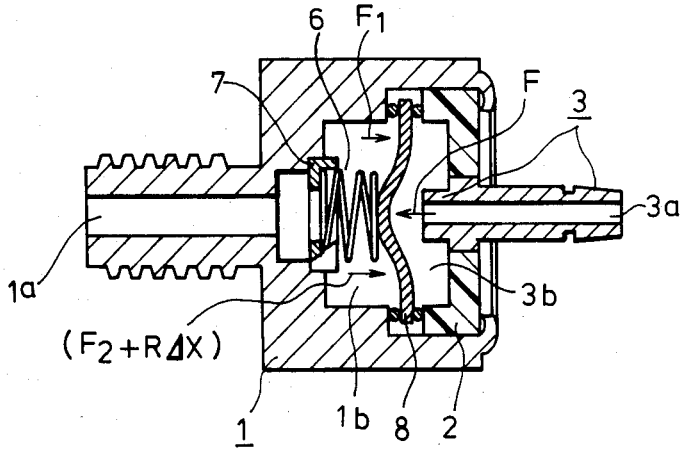
FIG. 3 is a cross-sectional side view of the embodiment of pressure-responsive apparatus of FIG. 2 in an open state.

In FIG. 3, which shows the OFF-state of a switch, the diaphragm 8 is spaced apart from the terminal 3, pushed by a force $(F_2+R\Delta x)$ of the spring 6, where R is the spring constant of spring 6 and $\Delta x$ is the compression of the spring between the first and second stable states of diaphragm 8. A driving force F at the center of the diaphragm 8 is caused by a difference between the pressure in the first chamber 1*b* and the pressure in the second chamber 3*b*.

When the driving force F increases (F is initially smaller than $F_1+F_2$), the diaphragm 8 is first in the state shown in FIG. 2. As F increases to a value equal to or greater than $(F_1+F_2)$, the state of the diaphragm 8 changes to the second stable state shown in FIG. 3, that is, the state of the switch changes from ON to OFF.

When the driving force F decreases (F is initially larger than $F_2+R\Delta x-F_1$), the diaphragm 8 is in the state as shown in FIG. 3. As F decreases to a value equal to or smaller than $(F_2+R\Delta x-F_1)$, the state of the diaphragm 8 changes to the first stable state as shown in FIG. 2, that is, the state of the switch changes from OFF to ON. The state of the switch, however, does not change as F changes between $(F_1+F_2)$ and $(F_2+R\Delta x-F_1)$; hysteresis of the diaphragm 8 is thus the difference, or $|2F_1-R\Delta x|$, and this value can be chosen arbitrarily.

Although in the above-described embodiment of the invention the diaphragm 8 functions as a moving contact in addition to a diaphragm, in other modified embodiments of the invention a separate moving contact may be prepared and fixed to the diaphragm 8.

In still other embodiments of the invention, the biasing means 6 may be a tension spring for pulling the diaphragm 8.

Figure 4:
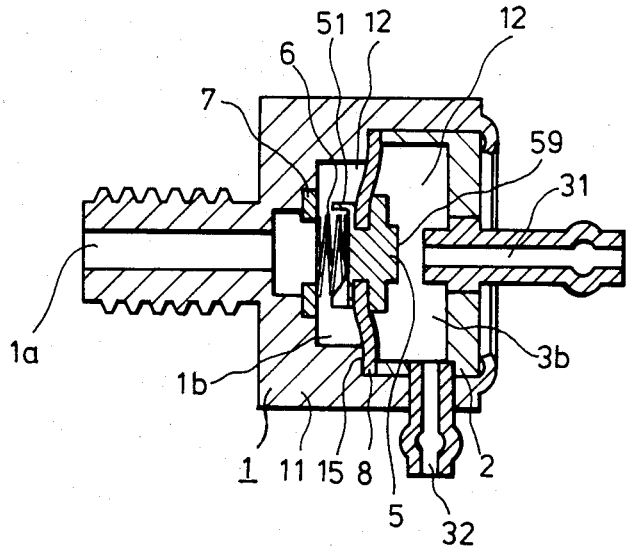
FIG. 4 is a cross-sectional side view of a preferred embodiment of pressure-responsive apparatus to be used as a fluid valve, embodying the present invention, in one state of operation.
Figure 5:
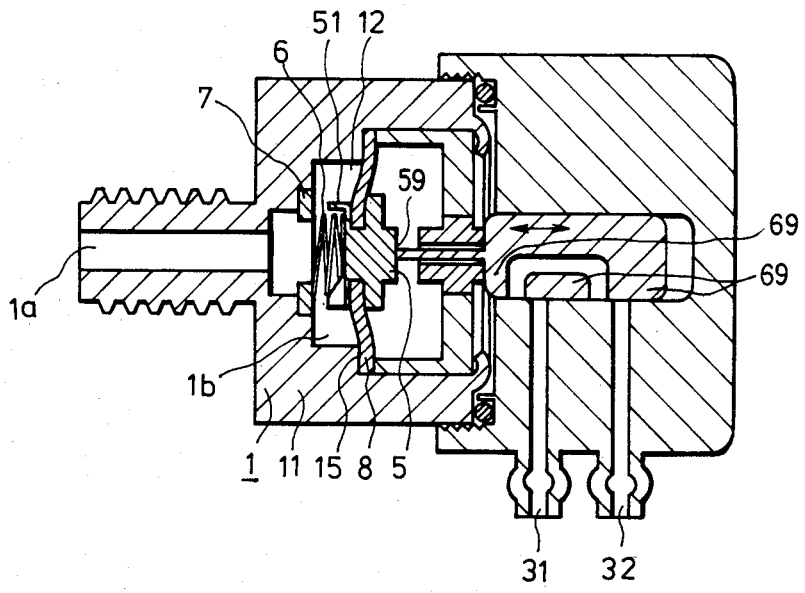
FIG. 5 is a cross-sectional side view of another embodiment of pressure-responsive apparatus to be used as a fluid valve, embodying the present invention, in one state of operation.

In further other embodiments of the invention the pressure-responsive apparatus may be constituted as a pressure-responsive valve for controlling fluid flow by utilizing the motion of the diaphragm 8, as shown in FIG. 4 and FIG. 5. In FIG. 4 and FIG. 5, numeral 31 is a first fluid port, numeral 32 is a second fluid port. A force transmitting element 5 is preferably carried centrally of diaphragm 8 and has a spring retaining rim on one side to hold an end of biasing spring 6 within chamber 1*b*. On the other side of diaphragm 8, the other end of element 5 has a flat central surface 49 which serves in the embodiment of FIG. 4 as a valve seat to close the first fluid port 31.

In the embodiment of FIG. 5, surface 59 transmits force to move a sliding valve 69 to open or close fluid ports 31 and 32.

In both FIGS. 4 and 5, diaphragm 8 rests against a peripheral shoulder 15 in case 1. A rim extension 51 surrounds and retains in place the end of spring 6 that presses against the central portion of diaphragm 8.

In still other embodiments of the invention, the pressure-responsive apparatus may be constituted as an apparatus having the functions of both a pressure-responsive valve and a switch.

As has been described in detail for various embodiments, the pressure-responsive apparatus in accordance with the present invention provides switching in electric circuits or fluid circuits without undesirable hunting, as a result of introducing difference between pressures of said first stable state and said second stable state, i.e., hysteresis, which in practice, can be arbitrarily selected. Such selection is made by giving a snap action characteristic to the diaphragm. By avoiding undesirable hunting, the operational lifetime of the pressure-responsive apparatus, as well as that of the related system or components, can be prolonged, making the apparatus more suitable for improved automatic control.

In this disclosure, there are shown and described only the preferred embodiments of the invention but, as aforementioned, it is to be understood that the invention is capable of use in various other combinations and environments and is capable of changes or modifications within the scope of the inventive concept as claimed herein.

What is claimed is:

1. A pressure responsive apparatus, comprising:

a case defining an internal volume and having a first fluid port and a second fluid port, said ports each being made of electrically conductive materials but electrically insulated from each other;

a snap-action diaphragm which has a first stable state and a second stable state, with a predetermined force required to cause it to go from each one of said states to the other, mounted nonrigidly in said case and electrically insulated therefrom by flexible peripherally disposed seals on both sides for partitioning said internal volume into a first chamber accessible to fluid via said first fluid port and a second chamber accessible to fluid via said second fluid port, said diaphragm having an electrically conducting portion;

an electrically conducting spring of known stiffness contacting at a first end said electrically conducting first fluid port and contacting at a second end said electrically conducting portion of said diaphragm, said spring then being deflected from its unstressed form by maximum predetermined biasing force on said diaphragm directed towards said second port such that when a predetermined pressure difference between said first and said second chambers is exceeded the combined fluid pressure force and spring bias force causes said diaphragm to move from said first stable state into said second state in which said electrically conducting portion of said diaphragm establishes contact with said electrically conducting second port, such that said first port, said spring, said electrically conducting portion and said second port cooperate to establish an electrically conductive path when said diaphragm is in contact with said second port.

2. A pressure responsive apparatus according to claim 1, wherein:

said diaphragm is made of metal.

3. A pressure responsive apparatus according to claim 1, wherein:

said electrically conducting portion of said diaphragm is comprised of a first material and the rest of the diaphragm is comprised of a second material.

4. A pressure responsive apparatus according to claim 1, wherein:

said case is provided with a third port which is located on the same side of said diaphragm as is said second fluid port; and said diaphragm exercises a valve control action with respect to flows between said second and third fluid ports coincidentally with its snap-action from said first stable state to said second stable state.

5. A pressure responsive apparatus according to claim 1, further comprising:

a moveable valve regulating an external flow, said valve being connected to said diaphragm such that movement of said diaphragm from said first stable state to said second stable state coincidentally exercises a control action of said movable valve.

* * * * *